US005335952A

United States Patent [19]

Clapper

[11] Patent Number: 5,335,952

[45] Date of Patent: Aug. 9, 1994

[54] APPARATUS AND METHOD FOR ANIMAL WASTE PICK-UP AND DISPOSAL

[76] Inventor: Millard Clapper, 8 Ter. Ave., Binghamton, N.Y. 13901

[21] Appl. No.: 142,078

[22] Filed: Oct. 28, 1993

[51] Int. Cl.[5] ..... A01K 29/00; E01H 1/12

[52] U.S. Cl. ..... 294/1.4; 294/100

[58] Field of Search ..... 294/1.3–1.5, 294/19.1, 55, 99.1, 100, 115; 15/257.1, 257.6, 257.7

[56] References Cited

U.S. PATENT DOCUMENTS

| | | | |
|---|---|---|---|
| 2,122,340 | 6/1938 | Durno | 294/100 |
| 2,380,136 | 7/1945 | Whitney | 294/100 |
| 3,446,525 | 6/1967 | Jones | 294/19 |
| 3,606,436 | 9/1971 | Lynch | 294/19 R |
| 3,819,220 | 6/1974 | Bredt | 294/1.5 |
| 3,848,906 | 11/1974 | Flieshman | 294/1.3 |
| 4,078,838 | 3/1978 | Nadratowski | 294/19 |
| 4,179,145 | 12/1979 | Shinsako | 294/1.4 |
| 4,194,777 | 3/1980 | Carns | 294/1 BA |
| 4,200,319 | 4/1980 | Cooper | 294/1.4 |
| 4,225,169 | 9/1980 | DeToma | 294/1 BA |
| 4,286,816 | 9/1981 | Tobias | 294/1.4 |
| 4,466,647 | 8/1984 | Spevak | 294/1.5 |
| 4,466,648 | 8/1984 | Albeiz | 294/1.4 |
| 4,819,977 | 4/1989 | Cooper | 294/1.4 |
| 5,203,598 | 4/1993 | Lindbauer | 294/1.4 |

FOREIGN PATENT DOCUMENTS

| | | | |
|---|---|---|---|
| 1202997 | 4/1986 | Canada | 294/1.4 |
| 3225602 | 1/1984 | Fed. Rep. of Germany | 294/1.3 |
| 2652102 | 3/1991 | France | 294/1.3 |

*Primary Examiner*—Dean J. Kramer
*Attorney, Agent, or Firm*—Charles S. McGuire

[57] ABSTRACT

A device for retrieving and disposing of animal waste in a bag and method of use thereof wherein no parts of the device come into contact with the waste and the operator need not manipulate or otherwise touch the bag after it has contacted the waste. A clean bag is placed over a pair of spring-biased scoop members carried on the distal end of an elongated shaft. The scoop members and bag are placed in a hollow sleeve, open at both ends, where the scoop members are retained with terminal edges thereof in closely adjacent relation by the sleeve walls. As the bag and scoop members are advanced out of the lower end of the sleeve, the scoop members are moved to spaced relation by spring biasing, and the closed end of the bag is placed over the waste. Moving the lower end of the sleeve back over the scoop members turns the bag inside-out, and the waste-containing bag may then be discarded by again advancing the scoop members out of the sleeve.

6 Claims, 2 Drawing Sheets

14
12
47
20
49
22
46
24
26
48
30
28
32

14
12
47
49
46
10
35
34
36
38
40
42
37

14
12
44
34

20
22
16
26
24
46
18
52
50
28
32

APPARATUS AND METHOD FOR ANIMAL WASTE PICK-UP AND DISPOSAL

BACKGROUND OF THE INVENTION

The present invention relates to apparatus and methods for picking up dog or other pet solid waste and, more particularly, to apparatus which may be manually manipulated to pick up and dispose of animal waste in a bag and to a method of utilizing such apparatus without manual contact with the waste-holding bag.

It is often desirable, and in some localities mandated by law, to retrieve pet droppings from streets, sidewalks, lawns, etc. Among prior art devices intended for such purpose are those shown in U.S. Pat. Nos. 3,446,525 dated May 27, 1969 of Jones, 3,606,436 dated Sep. 20, 1971 of Lynch, 4,078,838 dated Mar. 14, 1978 of Nadratowski, 4,194,777 dated Mar. 25, 1980 of Carns, 4,225,169 dated Sep. 30, 1980 of Detoma and 5,203,598 dated Apr. 20, 1993 of Lindlbauer. In general, the prior art apparatus includes numerous structural elements, linkages, etc., complicating construction and operation, and increasing fabrication and assembly costs. Moreover, the prior art apparatus and the manner of operation thereof brings the animal waste into contact with portions of the apparatus and/or requires operator manipulation of mechanical linkages and/or the waste-containing bag.

It is a principal object of the present invention to provide novel and improved apparatus for retrieving and disposing of animal droppings which is simple yet effective in operation, economical in construction, and rugged and durable in use.

Another object is to provide a method of placing animal droppings in a bag and disposing of the waste-containing bag without manual contact therewith other than initially placing the bag upon apparatus by which it is manipulated.

Other objects will in part be obvious and will in part appear hereinafter.

SUMMARY OF THE INVENTION

The apparatus of the invention includes a hollow sleeve, open at both ends, termed upper and lower ends, and preferably of rectangular cross section with a pair of wider and a pair of narrower, opposing side walls. An elongated shaft has proximal and distal ends with a handle at the proximal end. A pair of elongated strips of springy material are fixedly attached at one end of each near the distal end of the shaft on opposite sides thereof. The other ends of the strips extend beyond the distal end of the shaft and are fixedly attached to respective scoop members. The strips are bent at an intermediate position to diverge outwardly at the ends attached to the scoop members, holding the latter with respective, terminal edges thereof in a substantially parallel, spaced position. The strips may be flexed to move the scoop members toward one another, and are held in this position when the scoops and distal end of the shaft are positioned within the hollow sleeve.

In operation, the scoops are inserted into the open end of an ordinary bag, preferably of bio-degradable material with some slack placed in the closed end of the bag between the scoop members. The strips are flexed inwardly to move the scoop members into mutual proximity by manual pressure. The strips are then flexed inwardly to move the scoop members into mutual proximity by manual pressure. The distal end of the shaft, with the springy strips, scoop members and bag are then advanced into the upper end of the sleeve and the device is ready for operation. In order to retrieve animal waste, the shaft handle is grasped by one hand, while the other hand holds the sleeve, and the shaft is advanced until the scoop members and bag are outside the sleeve, thereby permitting the strips to return to their unflexed condition with the terminal edges of the scoop members in spaced relation and the outer surface of the closed end of the bag covering the waste.

The sleeve is then pushed downwardly over the scoop members, moving them back toward one another with the waste surrounded by the bag between the scoop members. The shaft is then moved longitudinally to retract the scoop members into the sleeve, with the bag automatically being turned inside-out in the process. The bag containing the waste may be disposed of simply by advancing the shaft to again move the scoop members outside the sleeve, and outward movement of the scoop members by the resilient strips releases the waste-containing bag into a suitable trash receptacle.

The foregoing and other features of the apparatus and its method of use will be more readily understood and fully appreciated from the following detailed description, taken in conjunction with the accompanying drawings.

DETAILED DESCRIPTION

Figures 1, 2, 3:
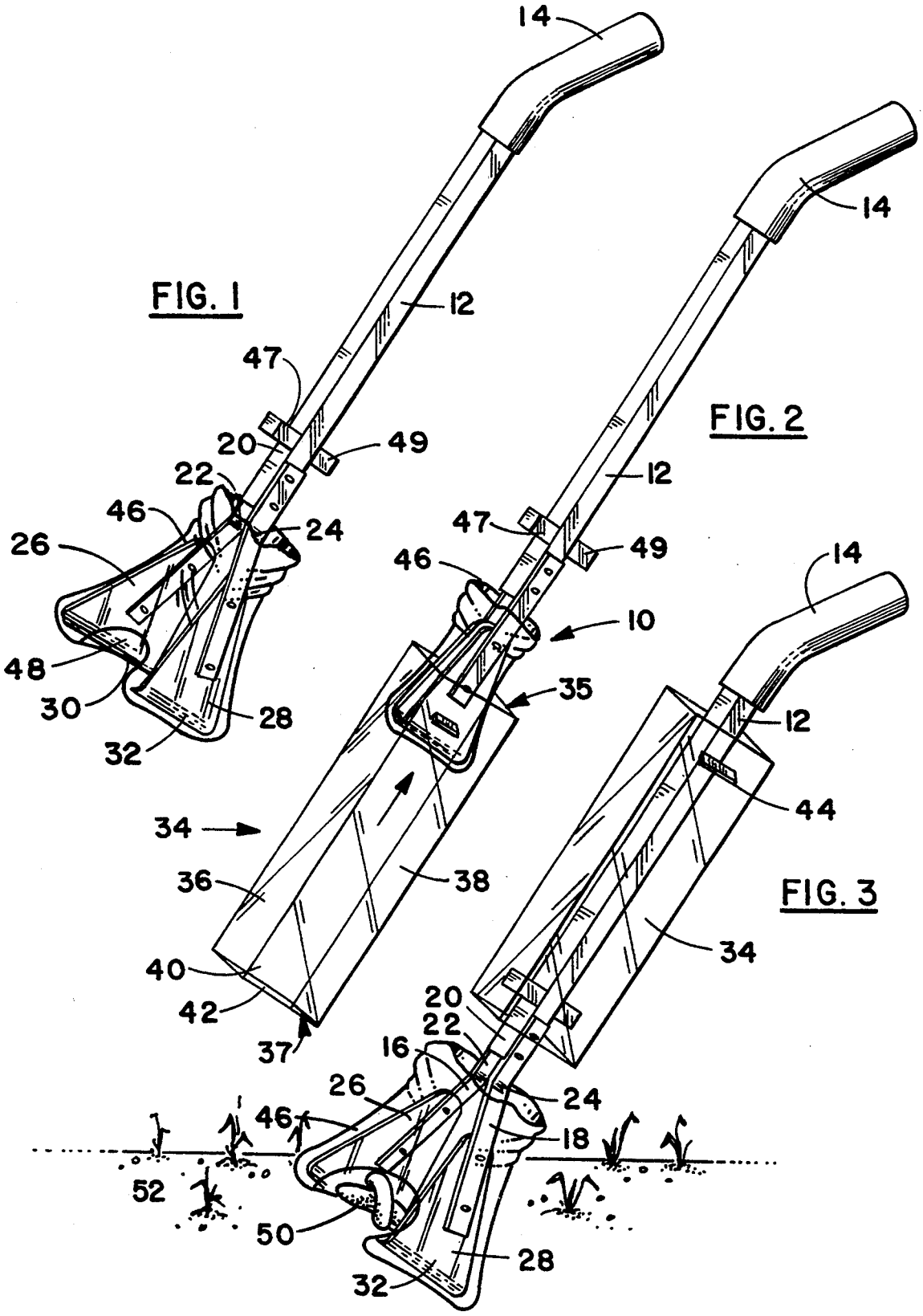
FIGS. 1–6 are all perspective views of the apparatus of the invention, shown in various relative positions of the elements, and sequentially illustrating the steps involved in practicing the method of the invention.

Referring now to the drawings, the apparatus or device 10 is seen to include elongated shaft 12, of rectangular or square cross section in the illustrated embodiment, having handle 14 at the proximal end thereof. A pair of strips 16 and 18, of suitable sheet metal or other inherently springy material, are fixedly attached at one end of each to opposite sides of shaft 12 near distal end 20 thereof. Each of strips 16 and 18 is bent at an intermediate position 22 and 24, respectively, to diverge toward the outer ends of the strips which extend past distal end 20 of shaft 12.

Figure 6:
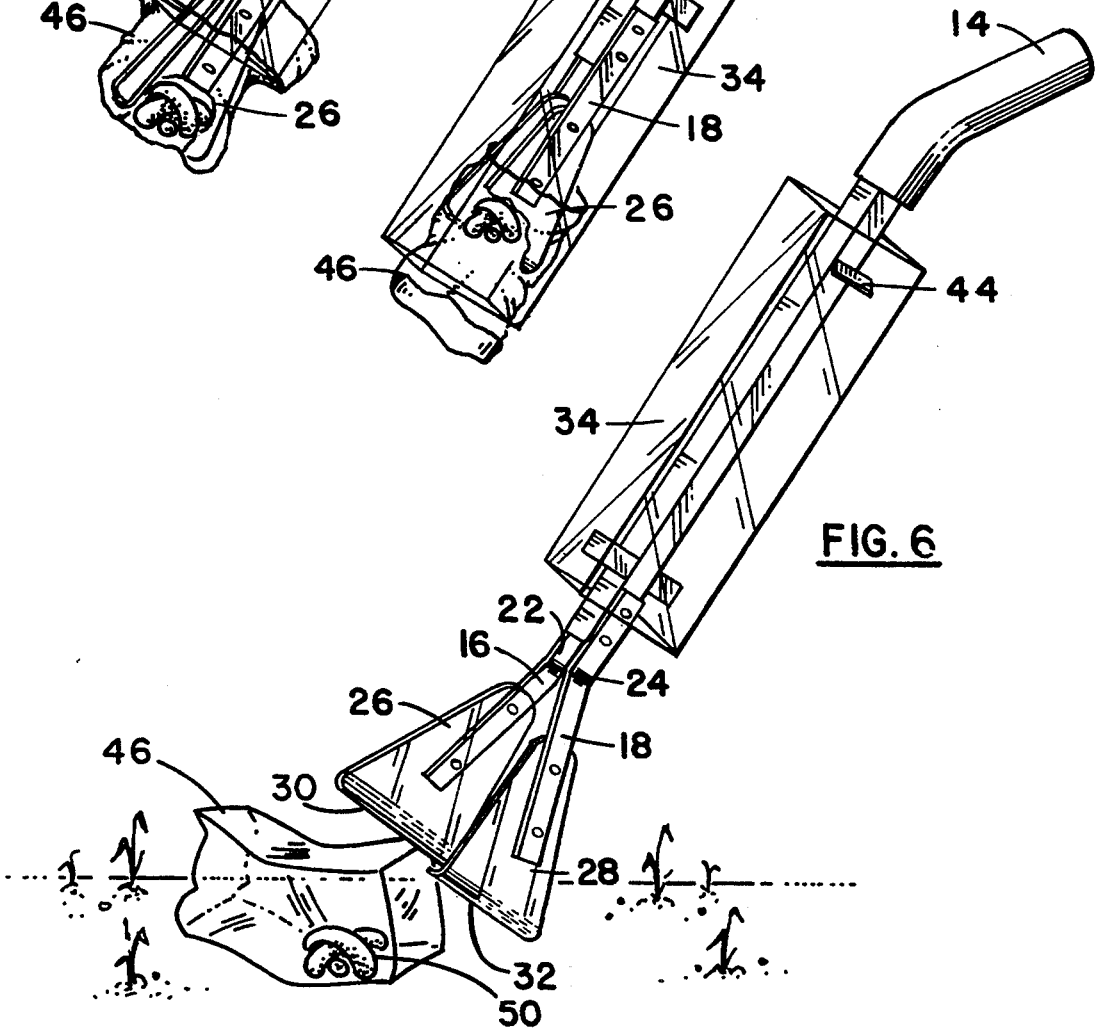

Scoop members 26 and 28 are fixedly attached to strips 16 and 18, respectively, for movement therewith as the strips are flexed inwardly from their unflexed, diverging positions of FIGS. 1, 3 and 6. Terminal edges 30 and 32 of scoop members 26 and 28, respectively are in substantially parallel, opposed relation in both the unflexed positions of strips 16 and 18, and in their inwardly flexed positions of FIGS. 2–5. Preferably, marginal portions of scoop members 26 and 28 are bent inwardly, as shown, so that terminal edges 30 and 32 directly oppose one another. Due to the resilient, springy nature of strips 16 and 18, they will return to their unflexed positions unless held in the inwardly flexed positions.

Another element of device 10 is hollow sleeve 34, open at both upper and lower ends 35 and 37, respectively, and of rectangular cross section in the illustrated embodiment, having a pair of narrower, opposed side walls 36 and 38, and a pair of wider, opposed side walls 40 and 42. Although sleeve 34 may be fabricated of any suitably rigid material, it is shown as being formed of a transparent plastic sheet material. Suitable handle means, such as that indicated by reference numeral 44 extending outwardly from side wall 40 near the upper end of the sleeve, may be provided for manual manipulation of sleeve 34 during operation of device 10 in a manner which will now be described.

To prepare device 10 for use, bag 46 is placed over scoop members 26 and 28 with some slack provided at the closed end of the bag between the scoop members, as indicated at 48. Bag 46 is of dimensions suitable for use in the manner to be described, taking into account the dimensions of the elements of device 10. For example, bag 46 may be a standard 11½"×12" transparent plastic, degradable bag, with sleeve 34 having a length of 11½" and the length from the proximal end of shaft 12 to terminal edges 30 and 32 of scoop members 26 and 28 being about 20" and the side-to-side length of terminal edges 30 and 32 about 4 to 6 inches.

The operator then holds scoop members 26 and 28 together, against the biasing force of strips 22 and 24, and the scoop members and bag are inserted into sleeve 34 through upper end 35, as shown in FIG. 2. Shaft 12 and sleeve 34 are moved longitudinally relative to one another, in the directions of the arrows in FIG. 2, until the scoop members and bag are at a position adjacent lower end 37. While within sleeve 34, the substantially planar scoop members 26 and 28 are in planes substantially parallel to the wider side walls 40 and 42, and rigid portions 47 and 49, extending laterally from opposite sides of shaft 12, assist in keeping the shaft centered between sleeve sidewalls 36 and 38. Device 10 is now ready for use.

In order to pick up animal waste 50 from surface 52, the operator holds sleeve 34 in one hand, e.g., by handle 44, and grasps handle 14 of shaft 12 in the other hand, advancing shaft 12 longitudinally until scoop members 26 and 28 and bag 46 are outside of the sleeve. This step should be performed with scoop members 26 and 28 directed downwardly so that the outer surface of the closed end of the bag covers animal waste 50, as shown in FIG. 3. Terminal edges 30 and 32, which are now in spaced relation as strips 16 and 18 return to their unflexed positions, contact surface 52 (with a layer of bag 46 therebetween) on opposite sides of waste 50.

Figure 4:
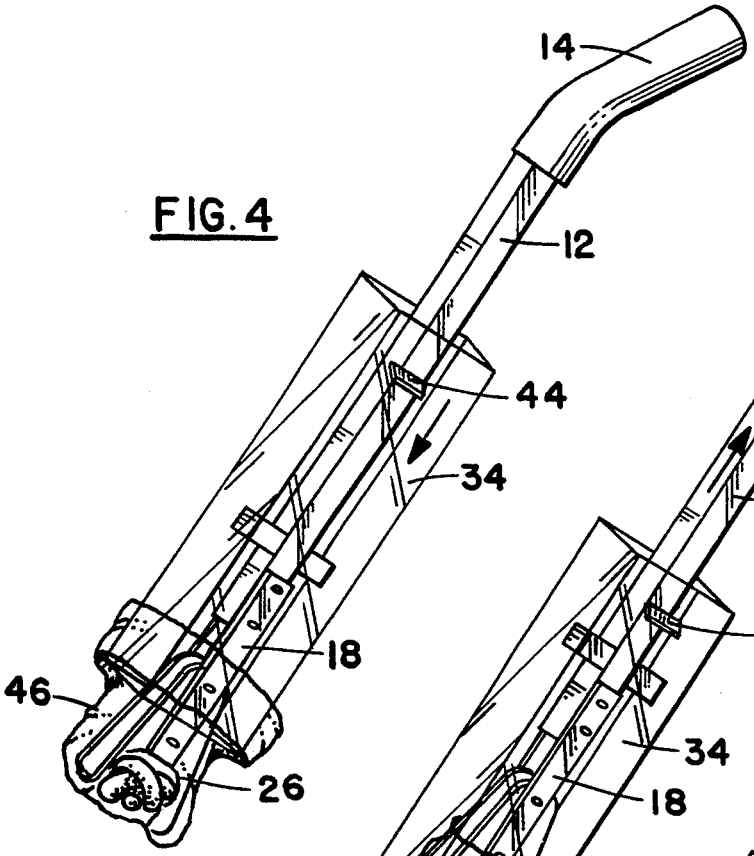
Figure 5:
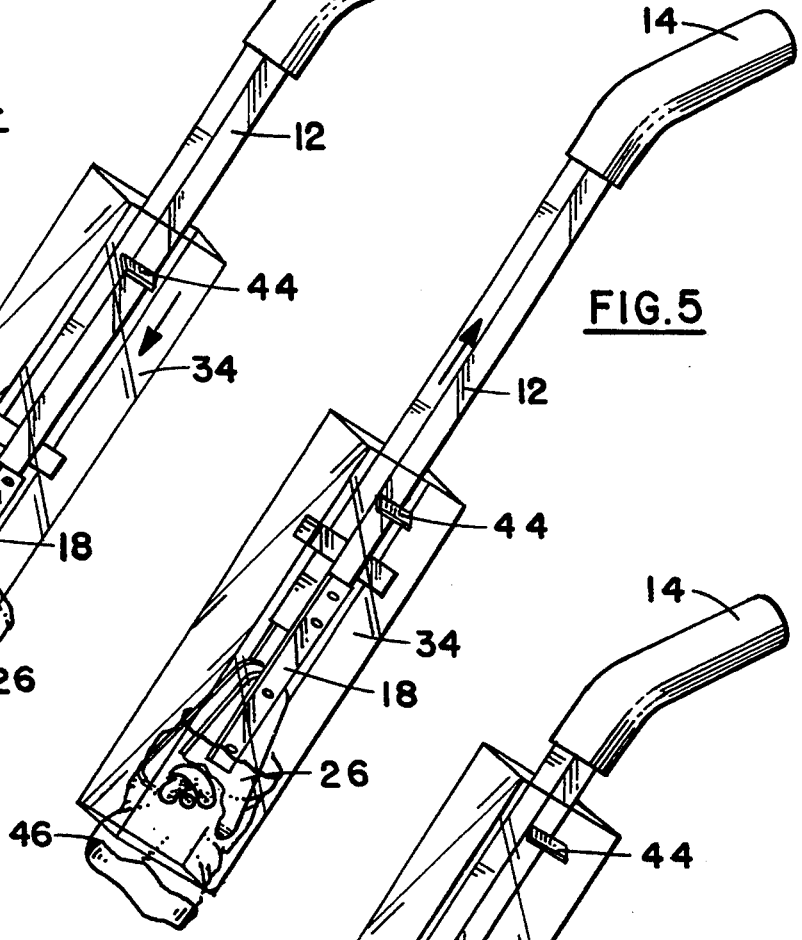

The operator then pushes sleeve 34 downwardly over scoop members 26 and 28, thereby moving terminal edges 30 and 32 back into closely adjacent relation, as shown in FIG. 4. It will be noted that as this step is performed, lower end 37 of sleeve 34 enters the open end of bag 46. Thus, as scoop members 26 and 28 are moved back into sleeve 34, to the position of FIG. 5, bag 46 is automatically turned inside-out without further intervention on the part of the operator. Waste 50 is now fully enclosed by the inside-out bag.

In order to discard the waste-containing bag, the operator simply places the lower end of sleeve 34 above or within an appropriate trash receptacle (not shown) and once again holds sleeve handle 44 in one hand while grasping shaft handle 14 in the other hand to effect relative longitudinal movement of the sleeve and shaft. As scoop members 26 and 28 move apart upon exiting sleeve 34, bag 46 containing waste 50 is dropped into the receptacle.

From the foregoing, it will be seen that the animal waste is quickly and effectively retrieved and discarded without coming into contact with either the operator or any part of device 10. Preparation of device 10 for use, by loading a clean bag, is a fast and simple matter. Device 10 has a minimal number of parts, all of which are simple and economical in both individual construction and mutual assembly. In fact, by the use of suitable materials and fabrication techniques, scoop members 26 and 28 may be integral with their associated springy strips 16 and 18, and possibly even with shaft 12, in which case the entire device would consist of only two parts.

What is claimed is:

1. A method of sanitary retrieval and disposal of animal waste utilizing a device including a hollow sleeve having a pair of opposed sidewalls and upper and lower, open ends, an elongated shaft having proximal and distal ends and carrying engagement means having terminal end portions extending beyond said distal end and movable between a first position, wherein said terminal end portions are in spaced relation, and a second position, wherein said terminal end portions are in closely adjacent relation, and means biasing said engagement means toward said first position, said method comprising:

a) inserting said engagement means into the open end of empty bag and providing slack in the closed end of said bag between said engagement means;

b) moving said engagement means to said second position and inserting said engagement means and bag into said sleeve through said upper end, said engagement means being retained in said second position by said sidewalls;

c) effecting a first relative longitudinal movement of said shaft and said sleeve to move said engagement means and empty bag out of said sleeve lower end, whereby said biasing means moves said engagement means to said first position;

d) holding said device to place said bag closed end over said waste with said terminal end portions of said engagement means on opposite sides of said waste;

e) moving said sleeve longitudinally to move said sleeve lower end over said engagement means, thereby moving said engagement means to said second position and turning said bag inside-out, and f) effecting a second relative longitudinal movement of said shaft and said sleeve to move said engagement means and waste containing bag out of said sleeve lower end, whereby said biasing means moves said engagement means to said first position, thereby releasing said waste-containing bag.

2. The method of claim 1 wherein said sleeve further includes handle means for manual grasping while effecting said first and second relative longitudinal movements of said engagement means and said sleeve, and said longitudinal movement of said sleeve to move said lower end over said engagement means.

3. The method of claim 1 wherein said sleeve is manually grasped with one hand at or adjacent said upper end while effecting said first and second relative longitudinal movements of said engagement means and said sleeve.

4. The method of claim 3 wherein said shaft proximal end is manually grasped with the other hand while effecting said first and second relative longitudinal movements of said shaft and said sleeve.

5. The method of claim 4 wherein said sleeve is manually grasped with one hand and said shaft proximal end is grasped with the other hand during said longitudinal movement of said sleeve to move said lower end over said engagement means.

6. The method of claim 1 wherein said sleeve is formed with a substantially uniform, rectangular cross section, and said engagement means comprise a pair of substantially planar members which are substantially parallel to said opposed side walls when said engagement means is within said sleeve.

* * * * *